US011766684B2

(12) United States Patent
Gong et al.

(10) Patent No.: US 11,766,684 B2
(45) Date of Patent: Sep. 26, 2023

(54) FAN-SHAPED AIR SUCTION SPRAY NOZZLE AUTOMATICALLY ADJUSTING AIR SUCTION SPEED

(71) Applicant: Jiangsu University, Jiangsu (CN)

(72) Inventors: Chen Gong, Jiangsu (CN); Dongyang Li, Jiangsu (CN); Yuli Wang, Jiangsu (CN); Bo Gao, Jiangsu (CN)

(73) Assignee: Jiangsu University, Jiangsu (CN)

( * ) Notice: Subject to any disclaimer, the term of this patent is extended or adjusted under 35 U.S.C. 154(b) by 96 days.

(21) Appl. No.: 17/608,995

(22) PCT Filed: Jan. 7, 2021

(86) PCT No.: PCT/CN2021/070587
§ 371 (c)(1),
(2) Date: Nov. 5, 2021

(87) PCT Pub. No.: WO2022/134223
PCT Pub. Date: Jun. 30, 2022

(65) Prior Publication Data

US 2022/0379324 A1 Dec. 1, 2022

(30) Foreign Application Priority Data

Dec. 21, 2020 (CN) ..... 202011521849.5

(51) Int. Cl.
*B05B 7/04* (2006.01)
*B05B 12/08* (2006.01)
(Continued)

(52) U.S. Cl.
CPC ..... *B05B 7/0475* (2013.01); *B05B 7/0425* (2013.01); *B05B 12/085* (2013.01);
(Continued)

(58) Field of Classification Search
CPC . B05B 12/1436; B05B 7/0475; B05B 7/0416; B05B 7/1254; B05B 7/0425
(Continued)

(56) References Cited

U.S. PATENT DOCUMENTS 7,506,824 B2 * 3/2009 Nau ..... B05B 7/0012 239/128
2006/0097072 A1 5/2006 Nau et al.

FOREIGN PATENT DOCUMENTS

CN 204486077 7/2015
CN 106423607 2/2017
(Continued)

OTHER PUBLICATIONS

"International Search Report (Form PCT/ISA/210) of PCT/CN2021/070587," dated Aug. 4, 2021, pp. 1-5.
(Continued)

*Primary Examiner* — Tuongminh N Pham
*Assistant Examiner* — Kevin Edward Schwartz
(74) *Attorney, Agent, or Firm* — JCIP GLOBAL INC.

(57) ABSTRACT

A fan-shaped air suction spray nozzle automatically adjusting an air suction speed is provided in the present invention, which includes a spray nozzle body and a liquid channel, the spray nozzle body being provided with a liquid channel in communication with a nozzle hole, and further includes a pressure groove and an air intake channel, wherein an inlet section of the liquid channel is in communication with the pressure groove, and the air intake channel is in communication with the liquid channel after penetrating through the pressure groove; an air intake orifice plate is installed in the pressure groove through an elastic damping apparatus, and a change of the pressure at an inlet of the liquid channel causes the air intake orifice plate to move between the pressure groove and the air intake channel; the air intake
(Continued)

orifice plate is provided with several through holes of the same or different sizes, which are configured to change the air intake volume in the liquid channel as the air intake orifice plate moves in the pressure groove.

11 Claims, 1 Drawing Sheet

(51) Int. Cl.
*B05B 7/12* (2006.01)
*B05B 12/14* (2006.01)

(52) U.S. Cl.
CPC ..... *B05B 7/0416* (2013.01); *B05B 7/1254* (2013.01); *B05B 12/1436* (2013.01)

(58) Field of Classification Search
USPC ..... 239/8
See application file for complete search history.

(56) References Cited

FOREIGN PATENT DOCUMENTS

| | | | | |
|---|---|---|---|---|
| CN | 109909086 | | 6/2019 | |
| CN | 111054530 | | 4/2020 | |
| WO | WO-2018097675 | A2 * | 5/2018 | ..... A62D 3/00 |

OTHER PUBLICATIONS

"Written Opinion of the International Searching Authority (Form PCT/ISA/237) of PCT/CN2021/070587," dated Aug. 4, 2021, pp. 1-3.

* cited by examiner

FAN-SHAPED AIR SUCTION SPRAY NOZZLE AUTOMATICALLY ADJUSTING AIR SUCTION SPEED

CROSS-REFERENCE TO RELATED APPLICATION

This application is a 371 of international application of PCT application serial no. PCT/CN2021/070587, filed on Jan. 7, 2021, which claims the priority benefit of China application no. 202011521849.5, filed on Dec. 21, 2020. The entirety of each of the above mentioned patent applications is hereby incorporated by reference herein and made a part of this specification.

TECHNICAL FIELD

The present invention relates to the field of plant protection mechanical atomization spray, and in particular, to a fan-shaped air suction spray nozzle automatically adjusting an air suction speed.

BACKGROUND

Spray drift is an important factor that affects the quality of spray operations and causes pesticide hazards. Air suction spray nozzles are an effective anti-drift technology. Based on the Venturi effect, an air suction spray nozzle automatically inhales air to mix with a medicine liquid, thus forming a gas-liquid mixed flow, and droplets formed by atomizing the gas-liquid mixed flow have a large particle size and are not easy to drift. According to the law of Kelvin-Helmholtz instability, instability occurs in a fluid with a shear force velocity or at an interface between two different fluids with a velocity difference. A greater gas-liquid velocity difference results in a more sufficient mixing of the two. However, an air intake channel of the existing air suction spray nozzle has a fixed structure, and the air intake speed cannot be adjusted. When the spray pressure changes, the air intake speed will be changed, and the appropriate air intake speed cannot be guaranteed. At the same time, an included angle of 90° is formed between a center line of the air intake channel and a center line of a liquid channel in the existing air suction spray nozzle, the mixing efficiency is limited when the air and the liquid collide, and the medicine liquid and the air cannot be fully mixed, thereby affecting the atomization effect.

SUMMARY

In view of the shortcomings in the prior art, the present invention provides a fan-shaped air suction spray nozzle automatically adjusting an air suction speed, which can automatically adjust an air intake speed according to the change in the pressure of a liquid flowing into the spray nozzle, and therefore, the inhaled air more fully collides with the liquid in an air intake straight column section of a liquid channel, so that the air and the pressure liquid are better mixed.

The present invention achieves the above technical objectives through the following technical means.

A fan-shaped air suction spray nozzle automatically adjusting an air suction speed comprises a spray nozzle body and a liquid channel, the spray nozzle body being provided with a liquid channel in communication with a nozzle hole, and further comprises a pressure groove and an air intake channel, wherein an inlet section of the liquid channel is in communication with the pressure groove, and the air intake channel is in communication with the liquid channel after penetrating through the pressure groove; an air intake orifice plate is installed in the pressure groove through an elastic damping apparatus, and a change in a pressure at an inlet of the liquid channel causes the air intake orifice plate to move between the pressure groove and the air intake channel; and the air intake orifice plate is provided with several through holes of the same or different sizes, which are configured to change an air intake volume in the liquid channel as the air intake orifice plate moves in the pressure groove.

Further, the air intake orifice plate is provided with several through holes of the same size; on the air intake orifice plate, the through holes are arranged from dense to gradually sparse from top to bottom; and an axial area of the through hole is 1/20 to 1/5 of an axial cross-sectional area of the air intake channel.

Further, an included angle α between a center line of the air intake channel and a center line of the liquid channel is an obtuse angle, and the included angle α is 90° to 145°.

Further, a sealing element is arranged between the air intake orifice plate and the pressure groove.

Further, at least two pressure grooves and two air intake channels are respectively arranged on the spray nozzle body symmetrically.

Further, the liquid channel is provided with a liquid inlet end straight column section, a tapered section, an air intake straight column section, a diverging section, and a liquid outlet end straight column section in sequence in a flow direction of a high-pressure liquid; the liquid inlet end straight column section is in communication with the pressure groove, and the air intake straight column section is in communication with the air intake channel.

Further, a ratio of an inlet diameter to an outlet diameter of the tapered section is 2:1, and a cone angle of a cross section of the tapered section is 25° to 45°.

Further, a ratio of an inlet diameter to an outlet diameter of the diverging section is 1:2, and a cone angle of a cross section of the diverging section is 30° to 60°.

A formula for a number n of through holes at an intersection of the air intake orifice plate and the air intake channel is:

$$n = \frac{1}{m} \times \frac{Q_s/v_s}{S_0} = \frac{1}{m} \times \frac{A_2 - mA_1}{S_0},$$

wherein:

$Q_s$ is the air intake volume, in $m^3/s$;

$S_0$ is an area of the through hole, in $m^2$;

m is the number of the air intake channels;

$v_s$ is an air intake speed, in m/s;

$A_1$ is an area of a cross section of a vertical center line of the air intake channel;

$A_2$ is an area of a cross section of the air intake straight column section.

Beneficial effects of the present invention lie in that: 1. The fan-shaped air suction spray nozzle automatically adjusting an air suction speed according to the present invention can automatically adjust the air intake speed according to the change in the pressure of the liquid flowing into the spray nozzle, and therefore, the inhaled air more fully collides with the liquid in the air intake straight column section of the liquid channel, so that the air and the pressure liquid are better mixed.

2. The fan-shaped air suction spray nozzle automatically adjusting an air suction speed according to the present invention provides the formula for the number n of through holes at the intersection of the air intake orifice plate and the air intake channel, which can better realize gas-liquid mixing.

Figure 1:
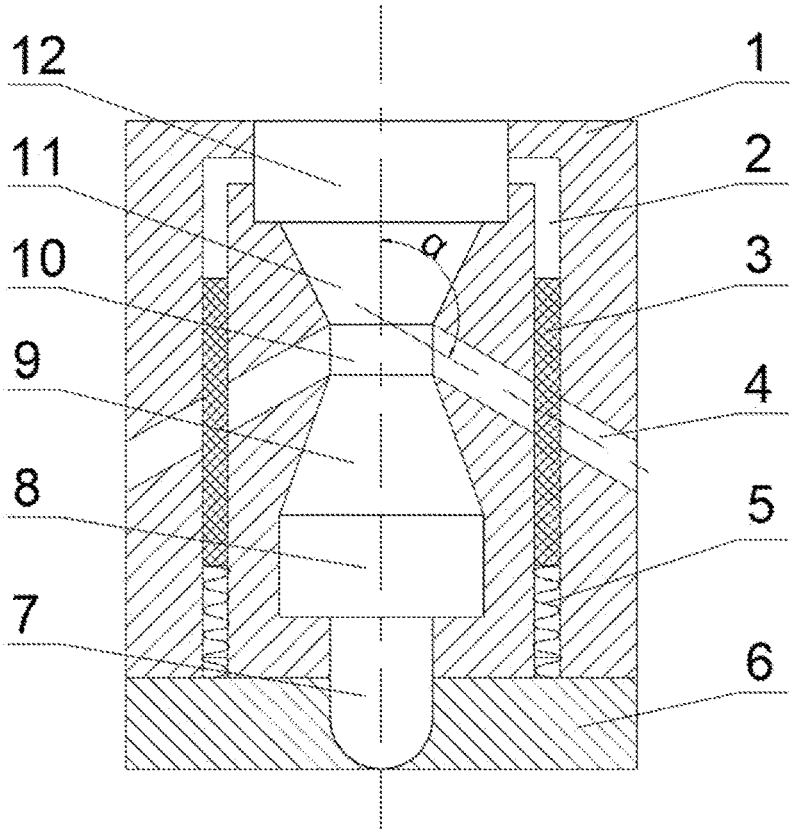
FIG. 1 is a schematic structural diagram of a fan-shaped air suction spray nozzle automatically adjusting an air suction speed according to the present invention.

1—spray nozzle body; 2—pressure groove; 3—air intake orifice plate; 4—air intake channel; 5—spring; 6—spring seat; 7—nozzle hole; 8—liquid outlet end straight column section; 9—diverging section; 10—air intake straight column section; 11—tapered section; 12—liquid inlet end straight column section.

DETAILED DESCRIPTION OF THE EMBODIMENTS

The present invention will be further described below with reference to the accompanying drawings and specific embodiments, but the protection scope of the present invention is not limited to this.

The embodiments of the present invention are described in detail below. Examples of the embodiments are shown in the accompanying drawings, in which identical or similar reference numerals indicate identical or similar elements or elements with identical or similar functions throughout the description. The embodiments described below with reference to the accompanying drawings are exemplary, and are intended to explain the present invention, but should not be construed as limiting the present invention.

In the description of the present invention, it should be understood that the orientation or positional relationship indicated by the term such as "center," "longitudinal," "transverse," "length," "width," "thickness," "upper," "lower," "axial," "radial," "vertical," "horizontal," "inner," and "outer" is based on the orientation or positional relationship shown in the accompanying drawing, and is only for the convenience of describing the present invention and simplifying the description, rather than indicating or implying that the indicated apparatus or element must have a specific orientation or must be constructed and operated in a specific orientation, thus cannot be understood as a limitation to the present invention. In addition, terms "first" and "second" are only used for descriptive purposes, and should not be understood as indicating or implying relative importance or implicitly indicating the number of indicated technical features. Thus, a feature defined with "first" or "second" may explicitly or implicitly include one or a plurality of the features. In the description of the present invention, "a plurality of" means two or more, unless otherwise specifically defined.

In the present invention, unless otherwise clearly specified and defined, the term such as "install," "interconnect," "connect," and "fix" should be understood in a broad sense, for example, it may be a fixed connection, a detachable connection, or an integral connection; it may be a mechanical connection or an electrical connection; it may be a direct interconnection or an interconnection through an intermediate medium, and it may be an internal communication between two elements. For those of ordinary skill in the art, the specific meaning of the above term in the present invention can be understood according to specific circumstances.

As shown in FIG. 1, a fan-shaped air suction spray nozzle automatically adjusting an air suction speed according to the present invention includes a spray nozzle body 1, a liquid channel, a pressure groove 2, and an air intake channel 4. The spray nozzle body 1 is provided with a liquid channel in communication with a nozzle hole 7, and the liquid channel is provided with a liquid inlet end straight column section 12, a tapered section 11, an air intake straight column section 10, a diverging section 9, and a liquid outlet end straight column section 8 in sequence in the flow direction of a high-pressure liquid. The liquid inlet end straight column section 12 is in communication with the pressure groove 2, and the air intake straight column section 10 is in communication with the air intake channel 4. The diameter at an outlet of the tapered section 11, the diameter of the air intake straight column section 10, and the diameter at an inlet of the diverging section 9 are equal. A ratio of the inlet diameter to the outlet diameter of the tapered section 11 is 2:1, and a cone angle of a cross section of the tapered section 11 is 25° to 45°. A ratio of the inlet diameter to the outlet diameter of the diverging section 9 is 1:2, and a cone angle of a cross section of the diverging section 9 is 30° to 60°. The air intake channel 4 is in communication with the liquid channel after penetrating through the pressure groove 2. An air intake orifice plate 3 is installed in the pressure groove 2 through an elastic damping apparatus, and a change in the pressure at an inlet of the liquid channel causes the air intake orifice plate 3 to move at an intersection of the pressure groove 2 and the air intake channel 4. The air intake orifice plate 3 is provided with several through holes of the same or different sizes, which are configured to change the air intake volume in the liquid channel as the air intake orifice plate 3 moves in the pressure groove 2.

FIG. 1 is Embodiment 1 of the present invention. The air intake orifice plate 3 is provided with several through holes of the same size. On the air intake orifice plate 3, the through holes are arranged from dense to gradually sparse from top to bottom. The air intake orifice plate 3 can move in the pressure groove 2 up and down in a liquid flow direction. A spring 5 is selected according to the size of the pressure groove 2, and the spring 5 is installed on a spring seat 6. The spring 5 and the spring seat 6 are installed on the spray nozzle body 1, and the spring seat 6 and the spray nozzle body 1 are fixed by buckles. The axial area of the through hole is 1/20 to 1/5 of the axial cross-sectional area of the air intake channel 4. The shape of the air intake orifice plate 3 is a rectangular parallelepiped. The air intake orifice plate 3 and the pressure groove 2 are closely matched, so the liquid will not enter the air intake channel 4 or enter the through hole of the air intake orifice plate 3 from the pressure groove 2. The spray nozzle body 1 is installed on a spray rod of a sprayer, and a liquid pump is turned on. The liquid pumped into the spray nozzle carries a certain pressure, and the pressure liquid flows through the liquid channel and is finally ejected from the nozzle hole 7. The pressure liquid first enters the liquid inlet end straight column section 12 in the spray nozzle, part of the liquid enters the pressure groove 2 from the liquid inlet end straight column section 12, the pressure liquid presses the air intake orifice plate 3 in the pressure groove 2, then the air intake orifice plate 3 applies the pressure to the spring 5, and finally the air intake orifice plate 3 is in a balanced position under the balance of the pressure of the liquid and the elastic force of the spring 5, and this position is an air intake position in a balanced state.

The air passes through the air intake channel 4 at the balanced position of the air intake orifice plate 3, and collides with the pressure liquid in the air intake straight column section 10. An angle between the air flow and the liquid flow in the direction of collision is an obtuse angle α, and the included angle α is 90° to 145°, so that the liquid and air in the spray nozzle can better collide and mix. The air intake channel 4 matches the through holes on the air intake orifice plate 3 to ensure that the air intake speed is basically unchanged. The gas-liquid mixed flow enters the diverging section 9, the air and the liquid are further mixed, and then the mixture reaches the liquid outlet end straight column section 8 to be ejected from the nozzle hole 7 to form a spray, which is broken into droplets.

When the spray pressure is changed, for example, when the spray pressure is increased, the liquid pressure will push the air intake orifice plate 3 to move downward, and finally the air intake orifice plate 3 is in a new balanced position under the balance of the pressure of the liquid and the elastic force of the spring 5. At this time, the air intake channel 4 corresponds to an upper position of the air intake orifice plate 3, that is, the position where the number of through holes is relatively large. Correspondingly, the air intake volume is increased, the air intake area is increased, and the air intake speed is basically unchanged. When the spray pressure is reduced, the spring 5 will push the air intake orifice plate 3 to move upward. When the balanced position is reached, the air intake channel 4 corresponds to a lower position of the air intake orifice plate 3, that is, the position where the number of through holes is relatively small. Correspondingly, the air intake volume is reduced, the air intake area is reduced, and the air intake speed is basically unchanged. In short, the position of the air intake orifice plate 3 may be changed with the spray pressure to adjust the air intake speed, that is, the air intake speed of the spray nozzle is adjusted to ensure that the liquid medicine and the air are fully mixed.

The calculation of the number of through holes on the air intake orifice plate 3 that match the air intake channel 4 corresponding to the balanced position is that: When the working pressure $p_1$ of the liquid entering the spray nozzle and the flow Q of a single nozzle are given, according to the flow formula $$Q=Sv \quad ①$$

the liquid flow velocity $v_1$ at the inlet of the tapered section 11 and the liquid flow velocity $v_2$ at the outlet of the tapered section 11 can be obtained:

$$v_1 = \frac{Q}{S_1} \quad ②$$

$$v_2 = \frac{Q}{S_2} \quad ③$$

in the formulas, Q is the flow of the spray nozzle, in $m^3/s$; $S_1$ is the cross-sectional area at the inlet of the tapered section 11, in $m^2$; $S_2$ is the cross-sectional area at the outlet of the tapered section 11, in $m^2$; $v_1$ is the liquid flow velocity at the inlet of the tapered section 11, in m/s; $v_2$ is the liquid flow velocity at the outlet of the tapered section 11, in m/s.

According to the Bernoulli equation:

$$\frac{p_1}{\rho g} + \frac{v_1^2}{2g} = \frac{p_2}{\rho g} + \frac{v_2^2}{2g} \quad ④$$

the pressure at the outlet of the tapered section 11 can be calculated $$p_2 = p_1 + \frac{\rho v_1^2}{2} - \frac{\rho v_2^2}{2} \quad ⑤$$

in the formulas, $p_1$ is the liquid pressure at the inlet of the tapered section 11, in Pa; $p_2$ is the liquid pressure at the outlet of the tapered section 11, in Pa; ρ is the density of water, in $kg/m^3$; and g is the acceleration of gravity.

According to the air suction volume equation of the Venturi tube ejector:

$$Q_s = \mu\alpha A\sqrt{\frac{2\Delta p}{\rho}} \quad ⑥$$

the air intake volume $Q_s$ is calculated, wherein $\Delta p=p_1-p_2$, $$\mu = 1.167Q\sqrt{\frac{R}{\Delta P}}, \text{ and } \alpha = \sqrt{\frac{\gamma+1}{2\gamma+1}};$$

in the formulas, $Q_s$ is the air intake volume, in $m^3/s$; μ is the flow coefficient; α is related to the temperature, γ is the straight drop rate of atmospheric temperature, and is 1.4 for diatomic gases; R is the flow specific gravity of water, in $g/cm^3$; ΔP is the pressure difference, and is set equal to $p_1$, in 100 kPa; $A=A_2-mA_1$, $A_2$ is the area of the cross section of the air intake straight column section 10, $A_1$ is the area of the cross section of the vertical center line of the air intake channel 4; and m is the number of air intake channels 4. Δp is the pressure difference between the inlet of the tapered section 11 and the outlet of the tapered section 11, in Pa.

Then, the air intake speed is calculated according to the air suction speed equation:

$$v_s = \mu\alpha\sqrt{\frac{2\Delta p}{\rho}} \quad ⑦$$

in the formula, $v_s$ is the air intake speed, in m/s.

The actual required air intake area is calculated according to formula ①

$$S_3 = \frac{Q_s}{v_s} \quad ⑧$$

in the formula, $S_3$ is the actual required air intake area, in $m^2$.

Finally, the actual required number of through holes is calculated according to the area $S_0$ of the through hole on the air intake orifice plate 3 and the actual required air intake area $S_3$, and the number of through holes that a single air intake orifice plate 3 needs to provide is $$n = \frac{1}{m} \times \frac{S_3}{S_0}.$$

The number of through holes that the single air intake orifice plate 3 needs to provide, that is, the number of through holes on the single air intake orifice plate 3 matching the air intake channel 4 is $$n = \frac{1}{m} \times \frac{Q_s/v_s}{S_0} = \frac{1}{m} \times \frac{A_2 - mA_1}{S_0}.$$

The through holes are arranged from dense to gradually sparse from top to bottom. The specific position distribution of the through holes on the air intake orifice plate 3 is determined as follows:

Position distribution features of the through holes on the air intake orifice plate 3 are affected by the springs 5 with different elastic coefficients.

A formula for the liquid pressure is:

$$F_c = pS_c$$

in the formula: p is the pressure of the liquid flowing into the spray nozzle body 1, $S_c$ is the area of a contact surface between the liquid in the pressure groove 2 and the air intake orifice plate 3, and $F_C$ is the normal force of the liquid on the area $S_c$;

wherein the elastic force of the spring 5 is calculated according to the Hooke's law, and the deformation of the spring 5 is obtained $$x = \frac{F}{k}$$

In the formula: F is the elastic force of the spring 5, k is the elastic coefficient of the spring 5, and x is the deformation of the spring 5.

That is, the balanced position meets $F=F_C$, that is, it meets $$kx = pS_c.$$

After the spring 5 is selected, a relational expression between the number of through holes on the single air intake orifice plate 3 matching the air intake channel 4 and the compression amount of the spring 5 can be established, thereby determining the position distribution features of the through holes on the air intake orifice plate 3.

Embodiment 2

According to research results of the existing air suction spray nozzles, when a fan-shaped air suction spray nozzle capable of automatically adjusting the air suction volume with reference to this embodiment operates, the diameter of the inlet of the tapered section 11 is set to be 6 mm, and the diameter of the outlet of the tapered section 11 and the diameter of the air intake straight column section 6 are set to be 3 mm. The cross section of the air intake channel 4 is set to be a rectangle with a length of 3 mm and a width of 1.5 mm. The shape of the air intake orifice plate 3 is set to be 9 mm in length, 4.5 mm in width, and 2 mm in thickness, and the area $S_c$ of a contact surface between the air intake orifice plate 3 and the liquid in the pressure groove 2 is the product of the width and thickness of the air intake orifice plate 3, that is, $S_c$ is 9 $mm^2$. The diameter of the through hole on the air intake orifice plate 3 is set to be 0.4 mm, that is, the area $S_0$ of the through hole is 0.1256 $mm^2$. The spring 5 is set to be a wire coil spring with an outer diameter of 2 mm, a natural length of 6 mm, and an elastic coefficient k of 1 N/mm.

From the above conclusions, according to the expression $$n = \frac{1}{m} \times \frac{Q_s/v_s}{S_0} = \frac{1}{m} \times \frac{A_2 - mA_1}{S_0},$$

the number of through holes that a single air intake orifice plate 3 needs to provide can be calculated.

According to the condition that the balanced position meets $F=F_C$, the elastic force of the spring 5 and the compression amount of the spring 5 can be calculated. According to the compression amount of the spring 5, the cross-sectional size of the air intake channel 4, and the number of through holes that a single air intake orifice plate 3 needs to provide, the position distribution features of through holes on the air intake orifice plate 3 are determined.

For example, when the working pressure $p_1$ of the liquid entering the spray nozzle is 0.1 MPa and the flow Q of the spray nozzle is 0.68 L/min, according to the above formula, it can be obtained that the air intake volume $Q_s$ is $1.13\times10^{-7}$ $m^3/s$, the air intake velocity $v_s$ is 0.06 m/s, the number of through holes provided by the single air intake orifice plate 3 is 8, the elastic force F of the spring 5 is 0.9 N, the compression amount x of the spring 5 is 0.9 mm, and at this time, the position where the corresponding number of through holes on the air intake orifice plate 3 are located matches the air intake channel 4.

The air intake speed when the working pressure $p_1$ of the liquid entering the spray nozzle is 0.1 MPa and the flow Q of the spray nozzle is 0.68 L/min is taken as a reference standard. When the working pressure is increased, in order to ensure that the air intake speed is basically unchanged, the required air intake area on the air intake orifice plate 3 is determined according to the calculated air intake volume, and finally the required number of through holes is calculated through the required air intake area on the air intake orifice plate 3.

For example, when the working pressure $p_1$ of the liquid entering the spray nozzle is 0.3 MPa and the flow Q of the spray nozzle is 1.18 L/min, according to the above formula, it can be obtained that the air intake volume $Q_s$ is $2.05\times10^{-7}$ $m^3/s$, the required air intake area on the air intake orifice plate 3 is 3.42 $mm^2$, the required number of through holes is 14, the elastic force F of the spring 5 is 2.7 N, the compression amount x of the spring 5 is 2.7 mm, and at this time, the position where the corresponding number of through holes on the air intake orifice plate 3 are located matches the air intake channel 4.

For example, when the working pressure $p_1$ of the liquid entering the spray nozzle is 0.5 MPa and the flow Q of the spray nozzle is 1.52 L/min, according to the above formula, it can be obtained that the air intake volume $Q_s$ is $2.506\times10^{-7}$ $m^3/s$, the required number of through holes is 17, the elastic force F of the spring 5 is 4.5 N, the compression amount x of the spring 5 is 4.5 mm, and at this time, the position where the corresponding number of through holes on the air intake orifice plate 3 are located matches the air intake channel 4.

According to the above calculation results, the relationship between the working pressure of the liquid entering the spray nozzle and the compression amount of the spring 5 can be obtained: For every 0.1 MPa increase in the working pressure of the liquid, the compression amount of the spring 5 is increased by 0.9 mm.

Under the parameter conditions provided in this embodiment, the position distribution of the through holes on the air intake orifice plate 3 can be obtained. The relational expression of the number n of through holes on the single air intake orifice plate 3 matching the air intake channel 4 and the compression amount x of the spring 5 can be simply expressed as:

$$x=0.014\,n^2$$

Figure 2:
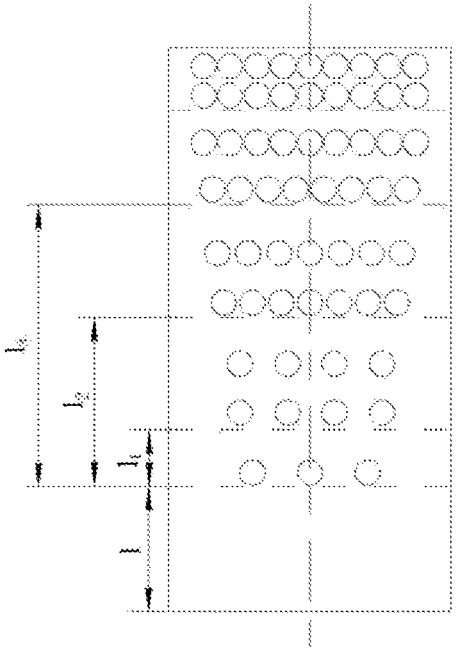
FIG. 2 is a schematic structural diagram of an air intake orifice plate according to an embodiment of the present invention.

As shown in FIG. 2, one end of the air intake orifice plate 3 in contact with the spring 5 is taken as a reference surface: In a natural state of the spring 5, a position of the air intake orifice plate 3 2 mm from the reference surface is in contact with a lower end of the air intake channel 4, and through holes are arranged starting from the position. The position is recorded as an air intake initial position, and a distance from the reference surface to the air intake initial position is recorded as l.

When the working pressure $p_1$ of the liquid entering the spray nozzle is 0.1 MPa, the compression amount x of the spring 5 is 0.9 mm, that is, the moving distance of the air intake orifice plate 3 is 0.9 mm, and the distance 0.9 mm from the air intake initial position on the air intake orifice plate 3 in a direction opposite to the movement thereof is recorded as $l_1$.

When the working pressure $p_1$ of the liquid entering the spray nozzle is 0.3 MPa, the compression amount x of the spring 5 is 2.7 mm, that is, the moving distance of the air intake orifice plate 3 is 2.7 mm, and the distance 2.7 mm from the air intake initial position on the air intake orifice plate 3 in a direction opposite to the movement thereof is recorded as $l_2$.

When the working pressure $p_1$ of the liquid entering the spray nozzle is 0.5 MPa, the compression amount x of the spring 5 is 4.5 mm, that is, the moving distance of the air intake orifice plate 3 is 4.5 mm, and the distance 4.5 mm from the air intake initial position on the air intake orifice plate 3 in a direction opposite to the movement thereof is recorded as $l_3$.

It should be understood that although this specification is described in accordance with various embodiments, each embodiment does not necessarily contain only one independent technical solution. This narration in the specification is only for clarity, and those skilled in the art should regard the specification as a whole. The technical solutions in the various embodiments can also be appropriately combined to form other implementations that can be understood by those skilled in the art.

The series of detailed descriptions listed above are only specific descriptions of feasible embodiments of the present invention, and they are not used to limit the protection scope of the present invention. All equivalent embodiments or changes made without departing from the processing spirit of the present invention shall be included in the protection scope of the present invention.

What is claimed is:

1. An air suction spray nozzle that automatically adjusts an air suction speed, comprising a spray nozzle body, the spray nozzle body being provided with a liquid channel in communication with a nozzle hole, and further comprising a pressure groove and an air intake channel, wherein an inlet section of the liquid channel is in communication with the pressure groove, and the air intake channel is in communication with the liquid channel after penetrating through the pressure groove; an air intake orifice plate is installed in the pressure groove with an elastic damping apparatus, and a change in a pressure at an inlet of the liquid channel causes the air intake orifice plate to move between the pressure groove and the air intake channel; and the air intake orifice plate is provided with multiple through holes of the same or different sizes, which are configured to change an air intake volume in the liquid channel as the air intake orifice plate moves in the pressure groove.

2. The air suction spray nozzle that automatically adjusts the air suction speed according to claim 1, wherein the through holes are of the same size; on the air intake orifice plate, the through holes are arranged in gradually decreasing density from top to bottom; and an axial area of each through hole is 1/20 to 1/5 of an axial cross-sectional area of the air intake channel.

3. The air suction spray nozzle that automatically adjusts the air suction speed according to claim 1, wherein an included angle α between a center line of the air intake channel and a center line of the liquid channel is 90° to 145°.

4. The air suction spray nozzle that automatically adjusts the air suction speed according to claim 1, wherein at least two pressure grooves and two air intake channels are respectively arranged on the spray nozzle body symmetrically.

5. The air suction spray nozzle that automatically adjusts the air suction speed according to claim 1, wherein the liquid channel is provided with a liquid inlet end straight column section, a tapered section, an air intake straight column section, a diverging section, and a liquid outlet end straight column section in sequence in a flow direction of a liquid; the liquid inlet end straight column section is in communication with the pressure groove, and the air intake straight column section is in communication with the air intake channel.

6. The fan shaped air suction spray nozzle that automatically adjusts the air suction speed according to claim 5, wherein a ratio of an inlet diameter to an outlet diameter of the tapered section is 2:1, and a cone angle of a cross section of the tapered section is 25° to 45°.

7. The air suction spray nozzle that automatically adjusts the air suction speed according to claim 5, wherein a ratio of an inlet diameter to an outlet diameter of the diverging section is 1:2, and a cone angle of a cross section of the diverging section is 30° to 60°.

8. The air suction spray nozzle that automatically adjusts the air suction speed according to claim 5, wherein a formula for a number n of through holes at an intersection of the air intake orifice plate and the air intake channel is:

$$n=\frac{1}{m}\times\frac{Q_s/v_s}{S_0}=\frac{1}{m}\times\frac{A_2-mA_1}{S_0},$$

wherein:

$Q_s$ is the air intake volume, in $m^3/s$;

$S_0$ is an area of the through hole, in $m^2$;

m is the number of the air intake channels;

$v_s$ is an air intake speed, in m/s;

$A_1$ is an area of a cross section of the air intake channel;

$A_2$ is an area of a cross section of the air intake straight column section.

9. The air suction spray nozzle that automatically adjusts the air suction speed according to claim 2, wherein the liquid channel is provided with a liquid inlet end straight column section, a tapered section, an air intake straight column section, a diverging section, and a liquid outlet end straight column section in sequence in a flow direction of a liquid; the liquid inlet end straight column section is in communication with the pressure groove, and the air intake straight column section is in communication with the air intake channel.

10. The air suction spray nozzle that automatically adjusts the air suction speed according to claim 3, wherein the liquid channel is provided with a liquid inlet end straight column section, a tapered section, an air intake straight column section, a diverging section, and a liquid outlet end straight column section in sequence in a flow direction of a liquid; the liquid inlet end straight column section is in communication with the pressure groove, and the air intake straight column section is in communication with the air intake channel.

11. The air suction spray nozzle that automatically adjusts the air suction speed according to claim 4, wherein the liquid channel is provided with a liquid inlet end straight column section, a tapered section, an air intake straight column section, a diverging section, and a liquid outlet end straight column section in sequence in a flow direction of a liquid; the liquid inlet end straight column section is in communication with the pressure groove, and the air intake straight column section is in communication with the air intake channel.

* * * * *